US005664613A

United States Patent [19]

Jelic

[11] Patent Number: 5,664,613

[45] Date of Patent: Sep. 9, 1997

[54] LIGHT CONTROL WINDOW COVERING

[75] Inventor: Ralph Jelic, Valencia, Pa.

[73] Assignee: Verosol USA Inc., Pittsburgh, Pa.

[21] Appl. No.: 657,521

[22] Filed: Jun. 3, 1996

[51] Int. Cl.[6] ..... E06B 9/06

[52] U.S. Cl. ..... 160/84.05; 160/121.1; 160/168.1

[58] Field of Search ..... 160/84.01, 84.05, 160/168.1 R, 168.1 V, 85, 89, 123, 126, 121.1

[56] References Cited

U.S. PATENT DOCUMENTS

| | | | |
|---|---|---|---|
| 2,140,049 | 12/1938 | Grauel | 160/85 X |
| 2,267,869 | 12/1941 | Loehr | 156/17 |
| 2,865,446 | 12/1958 | Cole | 160/85 |
| 3,384,519 | 5/1968 | Froget | 156/65 |
| 3,851,699 | 12/1974 | Shapiro | 160/166 |
| 4,677,013 | 6/1987 | Anderson | 428/116 |
| 5,106,444 | 4/1992 | Corey et al. | 156/197 |
| 5,313,999 | 5/1994 | Colson et al. | 160/121.1 |
| 5,339,882 | 8/1994 | Judkins | 160/84.1 |
| 5,339,883 | 8/1994 | Colson et al. | 160/84.05 |
| 5,454,414 | 10/1995 | Colson et al. | 160/168.1 V |
| 5,558,925 | 9/1996 | Fritzman | 160/84.01 |

FOREIGN PATENT DOCUMENTS

| | | |
|---|---|---|
| 0 482 793 | 4/1992 | European Pat. Off. . |
| 27 35 654 | 2/1979 | Germany . |
| 3525515 | 1/1987 | Germany . |

*Primary Examiner*—Blair Johnson
*Attorney, Agent, or Firm*—Buchanan Ingersoll, P.C.

[57] ABSTRACT

A window covering has a sheet of light admitting material which forms a back sheet and a series of spaced apart, generally parallel strips attached at one edge to the back sheet and attached at an opposite edge to an adjacent strip. Each strip contains a light impeding portion and a light admitting portion.

16 Claims, 7 Drawing Sheets

LIGHT CONTROL WINDOW COVERING

FIELD OF THE INVENTION

The invention relates to window coverings and particularly to a light control window covering having strips or slats that can be tilted from an open position to a closed position to control the amount of light which is admitted.

BACKGROUND OF THE ART

Venetian blinds are well-known window coverings. They have a series of horizontal slats hung from ladders which extend between a top rail and a bottom rail. The slats can be rotated between an open, see through position and a closed position. Additionally, the blinds can be raised and lowered. Venetian blinds contain aluminum, plastic or wood slats and are available in a limited number of colors.

Draperies are another common window covering. Draperies are available in a variety of materials and colors. Commonly a designer will provide a sheer curtain which permits some passage of light in combination with a heavier drapery through which light cannot pass. Consequently, the owner of that drapery system may have a completely open window, a window covered by the sheer which allows for daytime privacy, some passage of light and a view of the outside; or a window covered by the heavier drapery and a sheer which allows night time privacy, little passage of light, and no view of the outside.

Fabric window coverings and draperies are often preferred by consumers over venetian blinds because they have a softer appearance. However, draperies do not have the ability to control the amount of light transmitted through the window covering in a manner similar to louvered blinds like the traditional venetian blind.

Several attempts have been made to provide a fabric window covering with the ability to control the amount of light entering the room. Shapiro in U.S. Pat. No. 3,851,699 discloses a window draw drape having spaced apart light impeding and light transmitting vertical sections. The light impeding sections can be rotated to cover all or portions of the light admitting sections. The light impeding sections are vertical slats attached to the drapery or tightly woven fabric. The light admitting sections are open mesh. This product is difficult to operate because the light impeding sections tend not to align with the light admitting portions when those sections are rotated.

In U.S. Pat. No. 5,313,999 to Colson et al. there is a window covering having first and second parallel sheer fabric sides and a plurality of light impeding or somewhat light impeding vanes extending between the sheer fabric sides. The vanes are angularly controllable by relative movement of the sheer fabric sides. Like the combination of a sheer fabric and a light impeding fabric this system allows the user to have a fully open window, a sheer covered window allowing light transmission with day time privacy and a covering providing night time privacy or room darkening. In addition it has intermediate light control of a louvered product like venetian blinds. The Colson window covering system is difficult to manufacture, has a limited range of fabrics it can use, and has a very flat appearance when in the light impeding mode.

Another light control window covering system is disclosed in U.S. Pat. No. 3,384,519 to Froget. The window covering disclosed there consists of two cloth layers spaced apart by movable parallel blades having each of their marginal edges heat welded to one of the movable cloth layers. With this window covering relative movement of the two cloth layers in a direction perpendicular to the blades changes the angle of the blade and thus controls the amount of light emitted through the article. Because the blades must be heat welded to the cloth layers, only thermoplastic materials can be used. Also, heat welding necessarily requires a melting of some of the fibers of the material bonded, thus providing an uneven outer appearance along the heat welds and producing unwanted crimps or creases of the material which can result in fatigue failure. Furthermore, heat welding is a relatively slow process and the resulting weld is limited in strength.

Judkins in U.S. Pat. No. 5,339,882, discloses a window covering having a series of slats connected between two spaced apart sheets of material. The slats are substantially perpendicular to the sheets of material when the covering is in an open position. The slats are substantially parallel to the first and second sheets of material when the window covering is in a closed position. This product has many of the same limitations of the window covering disclosed by Colson.

There is a need for a window covering system which provides the light control of a venetian blind with the soft appearance of draperies and pleated shades. This window covering should be available in a wide variety of fabric, colors and styles. The system should be easy to install and to operate and able to be manufactured at a cost which allows the product to be sold at a competitive price.

SUMMARY OF THE INVENTION

I provide a light controllable window covering in which there is a back sheet and a series of strips connected to the back sheet. The strips are knitted or treated to have a light impeding or nearly light impeding first portion beside a light admitting second portion. The outside edge of each light impeding portion is attached to the back sheet. Then the strip is folded where the inside edges of the two portions meet so that the outside edge of the second portion abuts the strip below or above. That outside edge is attached to the adjacent strip to form a cell. Similar attachment of adjacent strips forms a light control honeycomb window covering.

The back sheet preferably is an open knit material through which light readily passes. Consequently, movement of the light impeding portion of the strips from a position perpendicular to the back sheet to a position generally parallel to the back sheet controls the amount of light which is admitted through the window covering.

The strips can be made from a single fabric, half of which is coated or laminated to form the light impeding portion. Alternatively, the strips could be woven to create light impeding portion and an adjacent light emitting portion.

The strips can be cut from lace or other fabrics having a decorative woven or knitted pattern. A sculptured edge may be provided on the outside edge of the light emitting portion of each strip which edge is attached to the adjacent strip.

A logo, message or other distinctive representation can be printed on or formed in the light impeding or nearly light impeding portion. Consequently, an owner could easily create a unique window covering for his windows.

Other objects and advantages of the invention will become apparent from a description of certain present preferred embodiments shown in the drawings.

DESCRIPTION OF THE PREFERRED EMBODIMENTS

Figure 1:
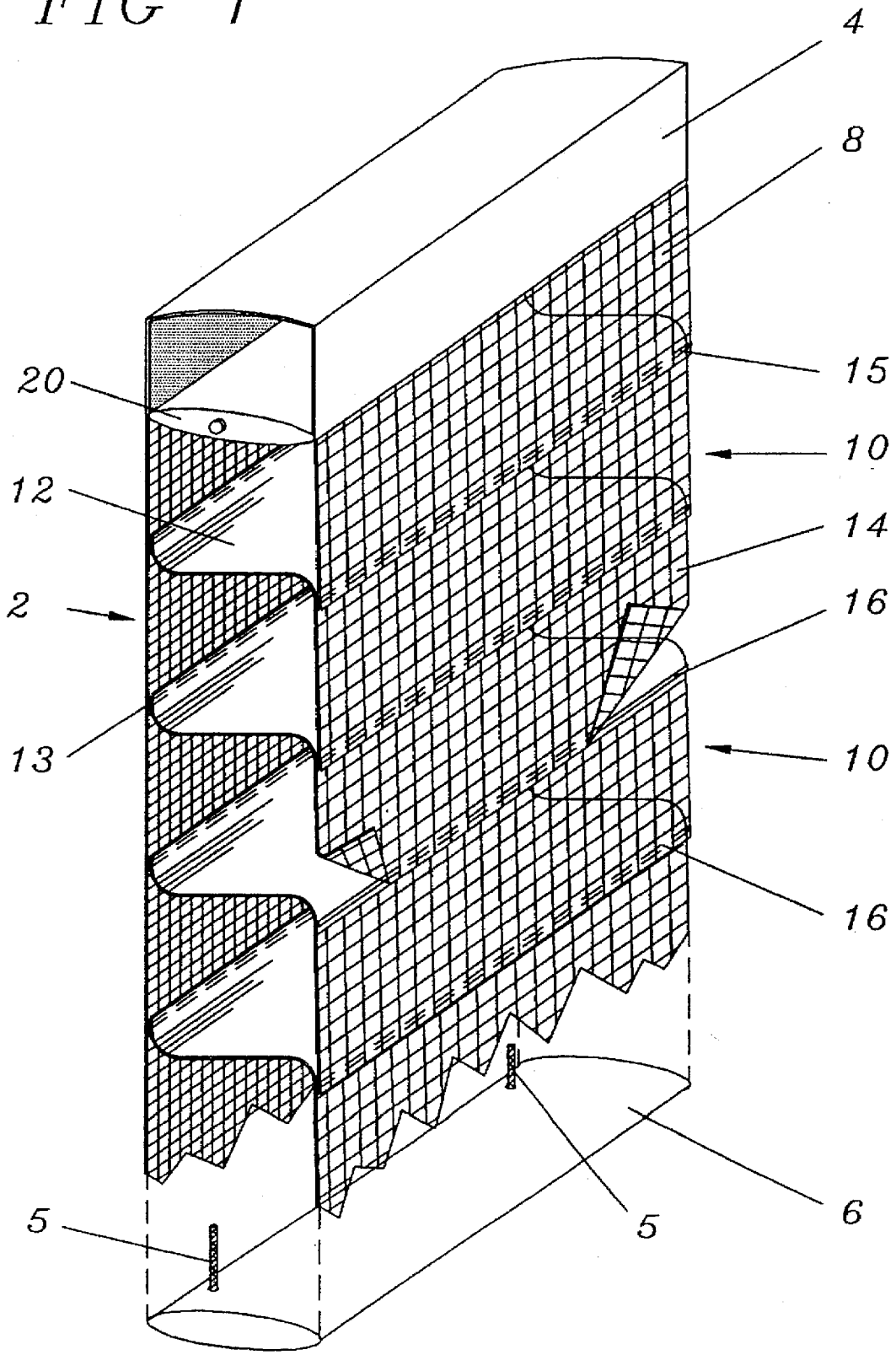
FIG. 1 is a perspective view of a first present preferred embodiment of my light control window covering.
Figure 4:
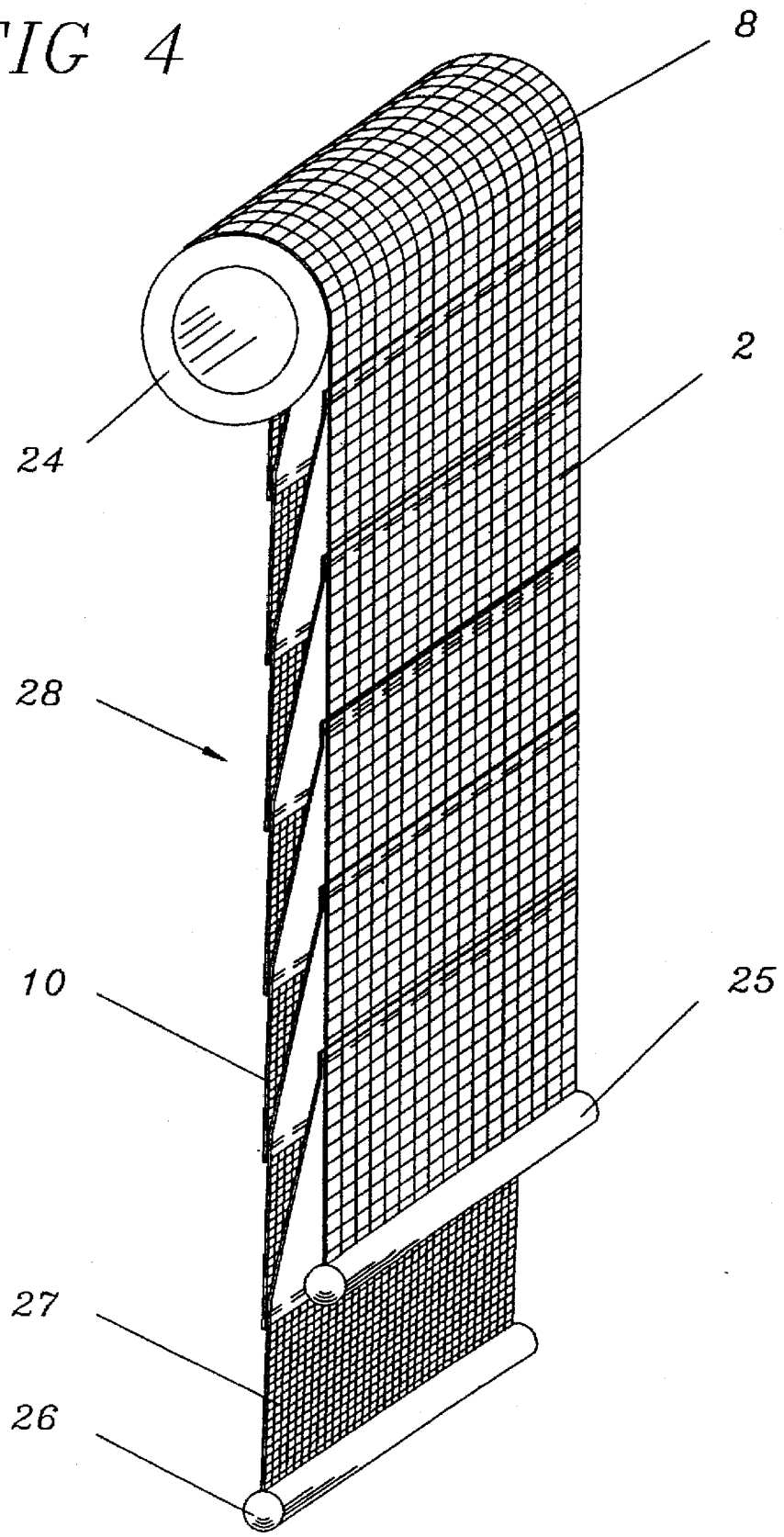
FIG. 4 is a perspective view of a fourth preferred embodiment of my light control window covering.

A perspective view of a first present preferred embodiment of my light control window covering 1 is shown in FIG. 1. This system is comprised of a back sheet 2 and set of strips 10 attached to the back sheet. Back sheet 2 extends from headrail 4 to bottom rail 6. The back sheet is made from an open knit or open weave fabric which allows light to readily pass through the fabric. A series of strips having an opaque or nearly opaque light impeding portion 12 and translucent or nearly transparent light admitting portion 14 extend from the back sheet 2. The outer edge of the light impeding portion 12 is glued, sewn or welded to the back sheet along bond lines 13. I prefer to provide a mandrel 20 within the headrail. The back sheet 2 and top front segment 8 are oppositely connected to the mandrel 20. Rotation of the mandrel in either direction will move the back sheet 2 relative to the light emitting portions 14 of the strips that form the front of the window covering. In this manner the orientation of the light impeding portions 12 are moved from a position perpendicular to the back sheet 2 as shown in FIG. 1 to a position nearly parallel to the back sheet. The light impeding portions in the embodiment shown in FIG. 4 are shown to be nearly parallel to the back sheet. Lift cords 5 preferably extend from the bottom rail 6 into the headrail 4. A lift mechanism (not shown) within the headrail raises and lowers the window covering. The lift cords can be placed only along the back of the window covering as shown, along both the front and the back, or through apertures (not shown) in the light impeding portions. In an alternative configuration the window covering could be rolled onto the mandrel to raise the window covering from an open to a closed position. The top segment of the front portion 8 is made of the same material as the light admitting portions 14 of the strips. The bottom edge of top segment 8 is glued, sewn or welded to the adjacent strip along bond line 15. Bond line 15 is near and substantially parallel to a line which separates the light impeding portion 12 of the strip 10 from the light admitting portion 14. The outer edge of the light admitting portion of each strip is bonded to the adjacent strip along bond line 16. Consequently, the combination of the back sheet and strips forms a cellular structure. This arrangement continues until the lowermost strip which is connected to the bottom rail 6.

Figure 2:
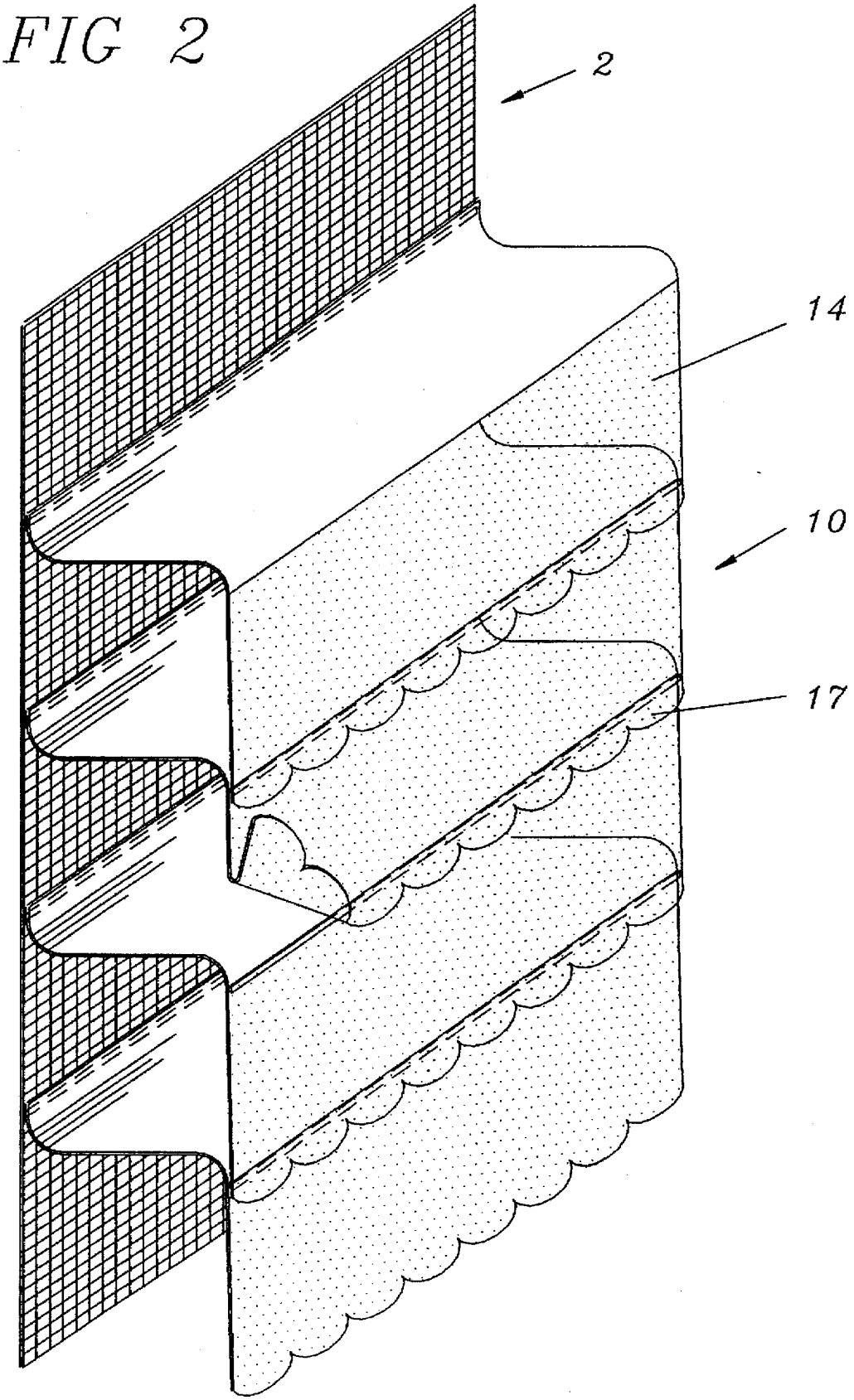
FIG. 2 is a perspective view of a second present preferred embodiment of my light control window covering.

In a second preferred embodiment illustrated in FIG. 2, I provide the same back sheet 2. However, in this embodiment the strips 10 are cut so that the outside edge of the light admitting portion 14 has a sculptured edge portion 17. A similar appearance could be created by forming a sculptured pattern along the inner face of the light impeding portion 12 and light admitting portion 14 of each strip. Although the window covering could be oriented to have either the back sheet 2 or the light admitting portions 14 of the strips 10 adjacent the window, in the embodiment of FIG. 2 the window covering would be oriented so that the sculptured pattern faces the room to show off the decorative edge.

In the embodiment of FIG. 1 the back sheet is shown as an open knit or open weave pattern having smaller openings than the light admitting portions of the strips. This is necessary to avoid a moiré pattern. In the embodiment shown in FIG. 2 the light admitting portions of the strips are shown to have an open weave mesh. This weave must be different from that of the back sheet to avoid the moiré effect.

Figure 3:
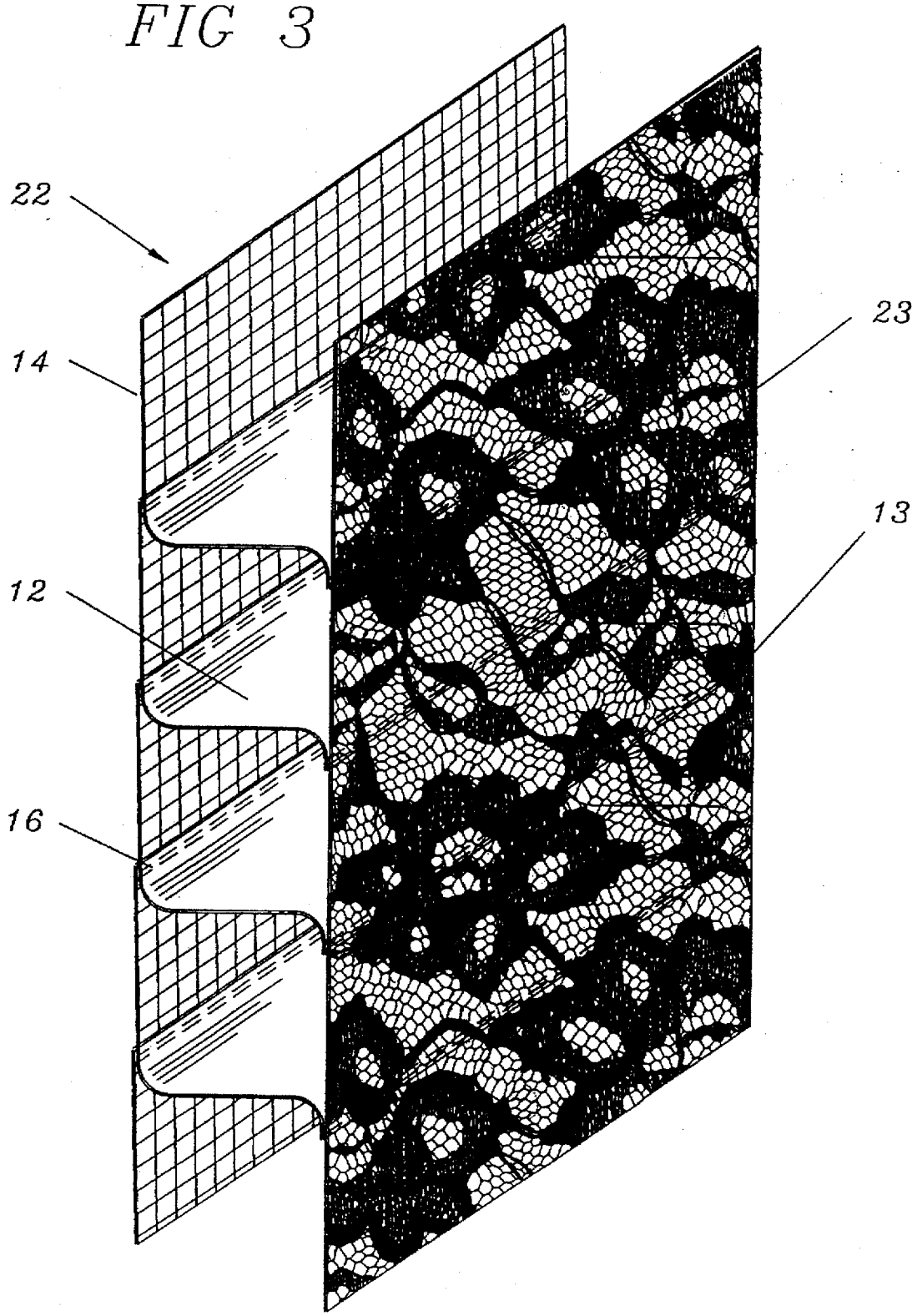
FIG. 3 is perspective view of a third preferred embodiment of my light control window covering.

In the embodiment of FIG. 3 the light admitting portions 14 of the strips form the back of the window covering. A sheet of light admitting material 23, shown as having a decorative lace pattern, forms the front of the window covering 22. As in the previous embodiments the outer edge of the light admitting portion is glued, sewn or welded along bond lines 16 to an adjacent strip. The outer edge of the light impeding portion 12 of each strip is glued, sewn or welded to the sheet of light admitting material 23 along bond lines 13.

The fourth present preferred embodiment shown in FIG. 4 is configured as a roller shade 28. In that embodiment the top of the back sheet of light admitting material 2 is attached to a roller 24. The upper portion 8 of the front is also attached to the roller. A series of strips 10 are connected to the back sheet 2 as in the first and second embodiments. Rather than provide a bottom rail I provide rods 25 and 26 at the bottom edge of the back sheet 2 and the bottom edge of the lowest strip 27.

Figure 5:
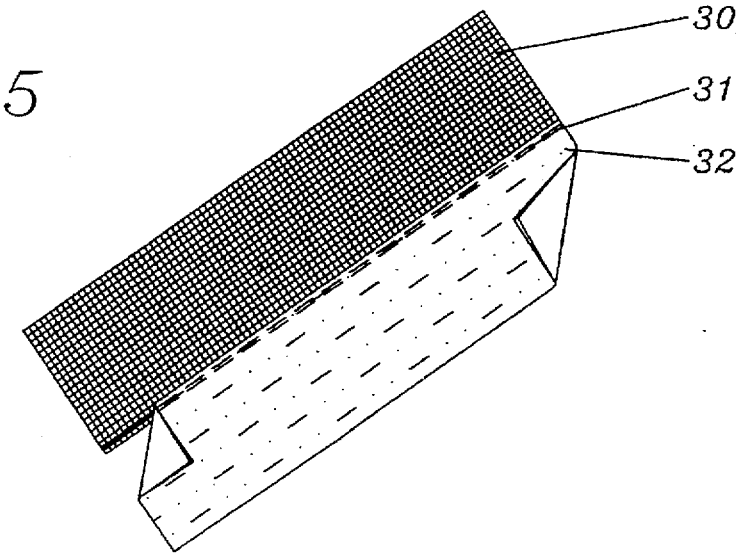
FIG. 5 is a top plan view of a first present preferred strip.

The strips used in the present window covering can be made in a variety of ways. In FIG. 5 I provide an elongated piece 30 of open weave or open knitted, light admitting material and an adjacent second strip of light impeding material 32. The light impeding material can be a tightly woven or tightly knit fabric, a non-woven material or a film. Elongated pieces 30 and 32 are glued, sewn or welded together along line 31.

Figure 6:
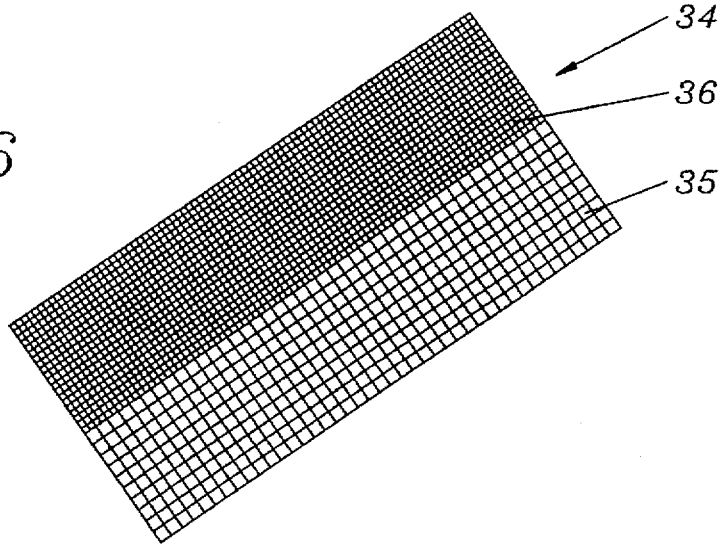
FIG. 6 is a top plan view of a second present preferred strip.

Another present preferred strip is shown in FIG. 6. This strip 34 is knitted as single piece. There is a light admitting region 35 having an open weave and a light impeding region 36 having a very tight weave. Thus, a single woven or knitted strip is formed having adjacent segments of different opacity.

Figure 7:
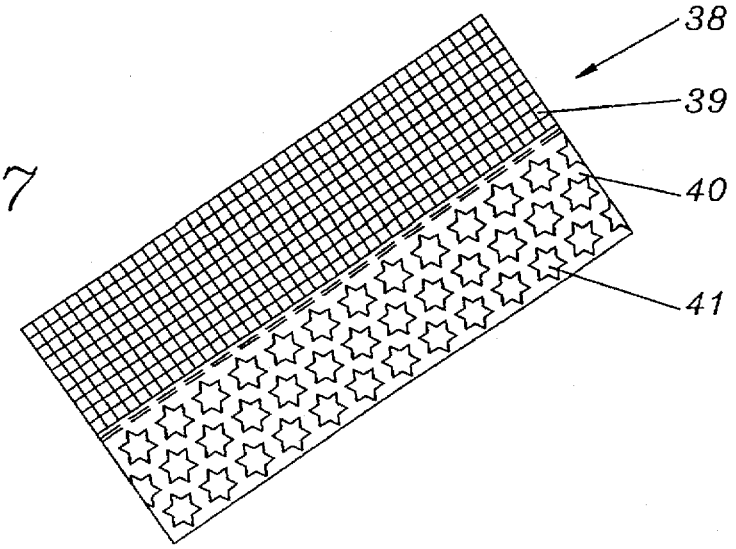
FIG. 7 is a top plan view of a third present preferred strip.

Another present preferred strip is shown in FIG. 7. That strip 38 has a woven or open knit portion 39 to which is glued sewn or welded a light impeding portion 40. The light impeding portion 40 may be tightly woven or non-woven material or a plastic strip or film, or even a metal or wooden slat. Portion 40 preferably has a series of imprints or cut outs 41 which give a decorative appearance to the light impeding portion of the strip 38.

Figure 8:
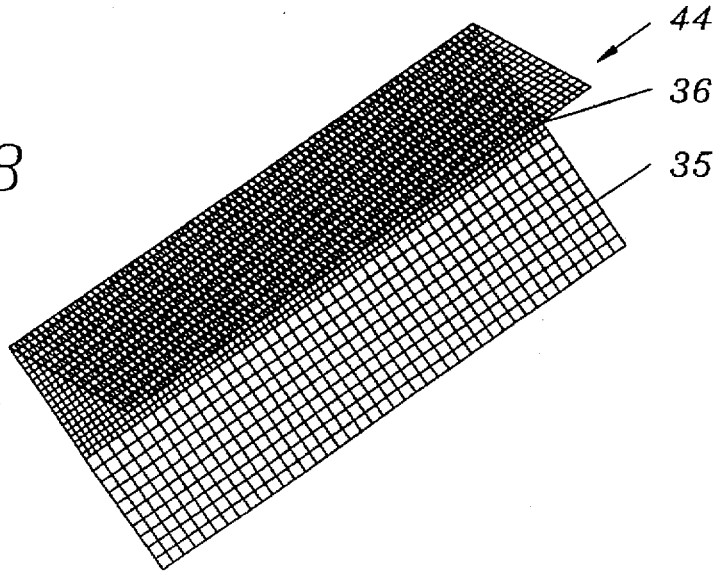
FIG. 8 is a top plan view of a fourth present preferred strip.

The strip 44 shown in FIG. 8 is made from a single knitted piece. That piece has an open weave light admitting portion 35 and a tightly woven light impeding portion 36. The tightly woven portion is folded back on itself as shown to complete the strip.

Figure 9:
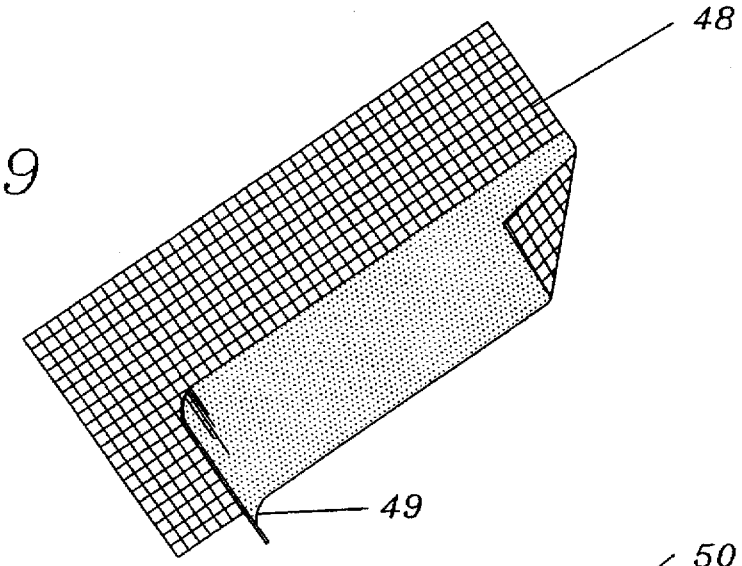
FIG. 9 is a top plan view of a fifth present preferred strip.

In the strip shown in FIG. 9 a single open weave sheet 48 is provided. A second strip 49 of light impeding material is laminated or bonded onto the open weave fabric 48. The light impeding material may be tightly woven or non-woven material or a plastic strip or film, or even a metal or wooden slat 40. The lights impeding strip could have a mirror surface.

Figure 10:
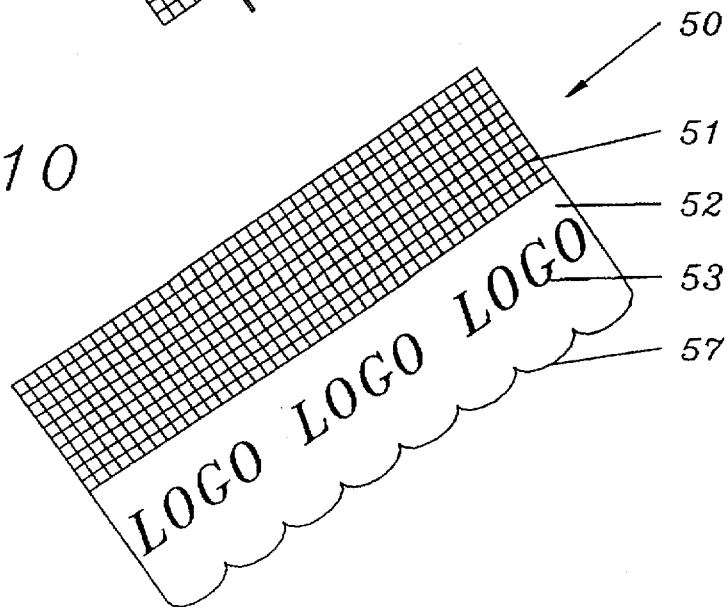
FIG. 10 is a top plan view of a sixth present preferred strip.

A sixth present preferred strip 50 is shown in FIG. 10. That strip has a light admitting portion 51 and a light impeding portion 52 with a sculptured edge 57. A logo 53 is printed on the light impeding portion. When a window covering having the strip 50 of FIG. 10 is in a closed position the logo will be visible through the back sheet.

Figure 11:
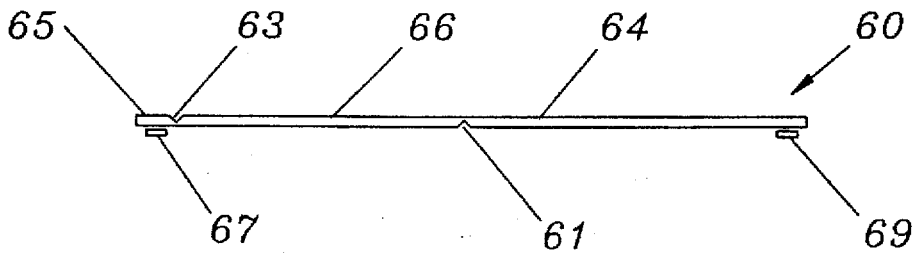
FIG. 11 is a side view of a seventh present preferred strip.
Figure 12:
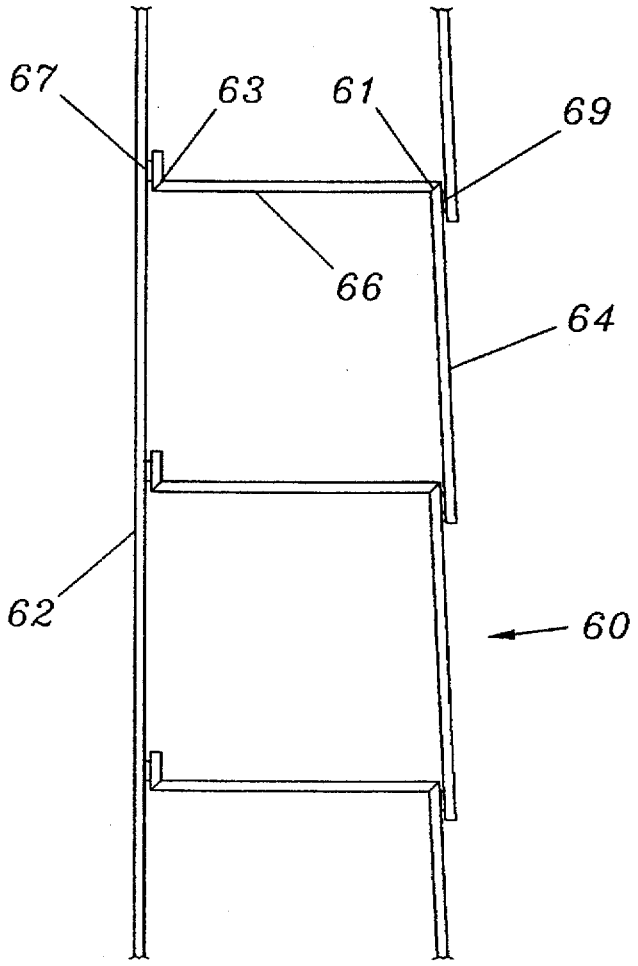
FIG. 12 is a side view of a light control window covering using the strip of FIG. 11.

Some materials, such as polyester films and laminates that can be used in my light control window covering have a stiffness that resists bending or folding. For those materials I prefer to provide a scored, perforated or compressed line at each fold as shown in FIGS. 11 and 12. The strip 60 has a light admitting portion 64 and a light impeding portion 66. One score line 61 is provided between the light admitting portion 64 and the light impeding portion 66. A second score line 63 is provided to define the tab section 65 of the light impeding portion 66 that is attached to the sheet of material 62. Glue lines 67 and 69 are placed on the strip 60 to attach each strip to the sheet of material and an adjacent strip to form the cellular structure shown in FIG. 12.

Because the cells in the present window covering are formed by a combination of a sheet and strips it is possible to make the width of the cells quite narrow. It is also possible to have different widths for the light admitting and light impeding portions of the strip thereby creating rectangular cells. Although the cells could be made to any dimension I prefer to provide square cells having sides of approximately 1½".

I also prefer that the light admitting portion of the strips be substantially more coarse than the sheer of the sheet. This difference will eliminate a moiré effect and provide a strip that is more easily handled during joining, gluing and transportation of the strip.

As previously stated the sheet and strips can be made of a variety of fabric. However, I prefer to use polyester material. I also prefer to glue the strips to the sheet and to glue adjacent strips using a copolyester hot melt adhesive which is tacky at a lower temperature typically around 220° F. and melts and flows at a higher temperature, usually around 350° F. While the adhesive is tacky the strips can be easily positioned. When properly positioned the temperature can be raised to melt the adhesive and the quickly cooled to complete the bond.

Although I have shown several present preferred embodiments of my light control window covering, it should be distinctly understood that the invention is not limited thereto but may be variously embodied within the scope of the following claims.

I claim:

1. A window covering comprising:

a. a sheet of light admitting material; and b. a plurality of strips each strip comprised of i. a light impeding portion having an outer edge attached to the sheet of light admitting material and an inner edge; and ii. a light admitting portion having an inner edge attached to the inner edge of the light impeding portion and an outer edge attached to an adjacent one of the plurality of strips such that the light impeding portions are bonded to the sheet along a series of spaced apart, generally parallel bond lines.

2. The window covering of claim 1 also comprising a headrail to which the sheet of light admitting material is attached.

3. The window covering of claim 2 also comprising a bottom rail to which the sheet of light admitting material is attached.

4. The window covering of claim 3 also comprising lift cords extending between the headrail and the bottom rail.

5. The window covering of claim 2 also comprising at least one rod attached to one of the sheet of light admitting material and one of the strips.

6. The window covering of claim 1 wherein the plurality of strips are comprised of an elongated piece of light admitting material to which an elongated piece of light impeding material is attached.

7. The window covering material of claim 6 wherein the elongated piece of light impeding material overlays the elongated piece of light admitting material.

8. The window covering of claim 1 wherein the light impeding portion has a mirror finish.

9. The window covering of claim 1 wherein the light impeding portion is imprinted with a logo.

10. The window covering of claim 1 wherein the strips are glued to the light admitting sheet.

11. The window covering of claim 10 where an adhesive that is tacky at a first temperature and melts at a second temperature glues the strips to the light admitting sheet.

12. The window covering of claim 11 wherein the adhesive is a polyester adhesive.

13. The window covering of claim 1 wherein the light admitting sheet is polyester.

14. The window covering of claim 1 wherein the light admitting portion has a width less than a width of the light impeding portion.

15. The window covering of claim 1 wherein the strips are lined with at least one of a score line, a perforated line and a compressed material line.

16. The window covering of claim 1 wherein each strip has at least one decorative edge.

* * * * *